US011754062B2

(12) United States Patent
Carrera et al.

(10) Patent No.: US 11,754,062 B2
(45) Date of Patent: Sep. 12, 2023

(54) METHODS AND SYSTEMS FOR COOLING A VACUUM PUMP

(71) Applicant: Thermo Finnigan LLC, San Jose, CA (US)

(72) Inventors: Jaime A. Carrera, Austin, TX (US); Dustin J. Kreft, Round Rock, TX (US)

(73) Assignee: THERMO FINNIGAN LLC, San Jose, CA (US)

( * ) Notice: Subject to any disclaimer, the term of this patent is extended or adjusted under 35 U.S.C. 154(b) by 0 days.

(21) Appl. No.: 17/700,163

(22) Filed: Mar. 21, 2022

(65) Prior Publication Data

US 2022/0213880 A1 Jul. 7, 2022

Related U.S. Application Data

(62) Division of application No. 16/530,477, filed on Aug. 2, 2019, now Pat. No. 11,293,422.

(51) Int. Cl.

| | |
|---|---|
| ***F04B 39/06*** | (2006.01) |
| ***F04B 41/06*** | (2006.01) |
| ***F04B 23/04*** | (2006.01) |
| ***H01J 49/24*** | (2006.01) |
| ***F04B 37/14*** | (2006.01) |
| ***F04D 25/16*** | (2006.01) |
| ***F04D 19/04*** | (2006.01) |
| ***F04D 17/16*** | (2006.01) |

(52) U.S. Cl.

CPC ..... *F04B 39/064* (2013.01); *F04B 23/04* (2013.01); *F04B 37/14* (2013.01); *F04D 17/168* (2013.01); *F04D 19/04* (2013.01); *F04D 25/16* (2013.01); *H01J 49/24* (2013.01); *F04B 41/06* (2013.01); *F04B 2201/0801* (2013.01); *F04D 19/042* (2013.01)

(58) Field of Classification Search

CPC ..... F04B 39/064; F04B 23/04; F04B 37/14; F04B 41/06; F04B 2201/0801; F04D 17/168; F04D 19/04; F04D 25/16; F04D 19/042; F04D 1/00; H01J 49/24

See application file for complete search history.

(56) References Cited

U.S. PATENT DOCUMENTS

| | | | |
|---|---|---|---|
| 7,056,108 B2 | 6/2006 | Behling et al. | |
| 8,015,841 B2 | 9/2011 | Cheng | |
| 11,293,422 B2 * | 4/2022 | Carrera | F04D 19/042 |

(Continued)

*Primary Examiner* — Charles G Freay

(74) *Attorney, Agent, or Firm* — Thomas F. Cooney

(57) ABSTRACT

A method comprises: heating a flow of coolant liquid by passing the flow through one or more fluidic tubing lines, channels or conduits that are in thermal contact with a housing of a vacuum pump; apportioning the flow of heated coolant liquid between a bypass fluid tubing line and a channel within a wall of a vacuum chamber; recombining the first and second partial flows of the heated coolant liquid; passing the recombined flow of the coolant liquid through a heat exchanger that cools the coolant liquid; and recirculating the cooled coolant liquid through the one or more fluidic tubing lines, channels or conduits that are in thermal contact with the vacuum pump housing, wherein the apportionment of the flow of the heated coolant liquid is automatically performed under the control of an electronic controller or computer in response to a temperature measurement received by the electronic controller or computer.

8 Claims, 4 Drawing Sheets

(56) References Cited

U.S. PATENT DOCUMENTS

| | | | | |
|---|---|---|---|---|
| 2007/0071646 | A1 | 3/2007 | Schoen et al. | |
| 2007/0291452 | A1 | 12/2007 | Gilliland et al. | |
| 2011/0174969 | A1 | 7/2011 | Seyfarth | |
| 2012/0062866 | A1 | 3/2012 | Binnard et al. | |
| 2014/0050850 | A1* | 2/2014 | Honda | C23C 14/541 118/724 |

* cited by examiner

METHODS AND SYSTEMS FOR COOLING A VACUUM PUMP

CROSS REFERENCE TO RELATED APPLICATION

This application claims, under 35 USC § 120, priority to and the benefit of the filing date of co-pending and commonly-assigned U.S. application Ser. No. 16/530,477, now U.S. Pat. No. 11,293,422, titled "Methods and Systems for Cooling a Vacuum Pump", the disclosure of which is hereby incorporated by reference herein in its entirety.

TECHNICAL FIELD

The present disclosure relates to scientific instruments and other apparatuses that incorporate vacuum systems and/or evacuated chambers.

BACKGROUND

Scientific instruments that use an internal pump to achieve vacuum in the measurement volume must be cooled in order to achieve best operation. The continual pump operation in an enclosed housing generates heat that must be exhausted for the instrument to function properly. Generally, vacuum pumps are air cooled with cooling fans typically being used to continuously cool the pump motor. Unfortunately, such air cooling limits overall instrument design as managing the heat load effectively is a balancing act between fan volume, air ducting space and system efficiency. Large vacuum pumps shorten the time required to achieve a target low pressure but disadvantageously require large or multiple fans to cool the pump and other surrounding components of the apparatus. The level of sound and vibrations produced by the apparatus' fans are generally considered undesirable. These effects may be especially severe when operating multiple apparatuses in the same laboratory space.

As an example, FIG. 1 is a simplified schematic diagram of a portion of a general conventional mass spectrometer system 1 comprising an atmospheric pressure ionization (API) source coupled to an evacuated analyzing region via an ion transfer tube. The various internal components of the mass spectrometer system are supported by and housed within the structural components of a chassis and housing, represented generally at 8 in the accompanying figures. It should be noted that the principles of the present teachings are generally applicable to many types of scientific apparatuses (including scientific analyses apparatuses) and other systems that employ vacuum chambers evacuated by vacuum pumps. Scientific analysis apparatuses of this type include mass spectrometers, scanning electron microscopes of the backscatter type, electron microprobes and transmission electron microscopes, among others. Other systems that may benefit from the present teachings include chemical vapor deposition systems such as are used in the semiconductor industry, among others. The description herein of a mass spectrometer system is intended merely as an exemplary representation of all such systems.

FIG. 1 illustrates a non-limiting schematic example of a mass spectrometer system. Referring to FIG. 1, an ion source 12 is housed in an ionization chamber 14 and is configured to receive a liquid or gas sample from an associated apparatus such as, for instance, a gas chromatograph, a syringe, or a capillary 7 that is fluidically coupled to a liquid chromatograph. In the illustrated example, the sample is a liquid sample and the ion source 12 is an atmospheric pressure ion source (API source) such as an electrospray ionization (ESI) source, a heated electrospray ionization (H-ESI) source, an atmospheric pressure chemical ionization (APCI) source, an atmospheric pressure matrix assisted laser desorption (MALDI) source or a photoionization source. Alternatively, if the sample is provided as a gas, such as a gas fraction that elutes from a gas chromatograph, then an Electron Ionization (EI) source may be employed, in which case the ionization chamber 14 is maintained at high vacuum. Regardless of the exact nature of the ion source 12, charged particles 9 that are representative of the sample are emitted from the source 12. The charged particles either are ions or, in the case of electrospray ionization, are charged droplets that may be desolvated so as to release ions.

The charged particles generated at the source 12 may be subsequently transported into a partitioned vacuum chamber 3 through either an aperture or an ion transfer tube 16 that passes through a first partition element or wall 11 into an intermediate-vacuum compartment 18. Although only a single intermediate-vacuum compartment is illustrated in the drawings, there may be additional intermediate-vacuum compartments between the illustrated compartment 18 and the high-vacuum compartment 26 within which a mass analyzer 28 is disposed.

In the illustrated example, in which the ion source 12 is an electrospray source, evaporation of solvent within the ionization chamber 14 and, if present, the ion transfer tube 16 liberates free ions into the intermediate-pressure chamber 18. The ion transfer tube 16, if present, may be physically coupled to a heating element or block 23 that provides heat to the gas and entrained particles in the ion transfer tube so as to aid in the desolvation of charged droplets so as to thereby release free ions. At least one ion optical assembly or ion lens 20 provides an electric field or electric fields that guide and focus the ion stream leaving ion transfer tube 16 through an aperture 22 in a second partition element or wall 15 that may be an aperture of a skimmer 21. Ions passing through the aperture 22 enter the high vacuum compartment 26 within which the internal pressure is typically maintained at about $10^{-5}$ Torr. A second ion optical assembly or lens 24 may be provided within the high-vacuum compartment 26 so as to transfer or guide ions to the mass analyzer 28. The mass analyzer 28 comprises one or more detectors 30 whose output can be displayed as a mass spectrum.

As ions travel downstream from the ionization chamber 14 to the high-vacuum compartment 26, they pass through a series of compartments of the vacuum chamber 3 having progressively reduced internal pressures. The pressure gradient across the chambers is maintained by differential vacuum pumping through a series of vacuum ports, with one vacuum port per chamber. Two such vacuum ports are illustrated in FIG. 1. Vacuum port 13 is used for evacuation of the intermediate-vacuum compartment 18 and vacuum port 19 is used for evacuation of the high-vacuum compartment 26. Each additional intermediate-vacuum compartment (not shown), if any, that is disposed between compartment 18 and the high-vacuum compartment 26 may comprise its own respective vacuum port. Generally, two or more vacuum pumps are required as a result of the differences in internal pressures between compartments. Typically, a mechanical positive-displacement pump 10, such as a rotary pump, is fluidically coupled to a vacuum port 13 via vacuum tube 17. In contrast, a diffusion pump or turbomolecular pump (not shown) may be fluidically coupled to the vacuum port 19 of the high-vacuum chamber. Additional pumps may be required for evacuation of additional intermediate-vacuum compartments. All such vacuum pumps generate heat.

Performance of an analytical scientific instrument, such as a mass spectrometer or electron microscope, is heavily influenced by the operating pressure inside the vacuum chamber. Thus, instruments having improved evacuation efficiency yield greater analytical efficiency. Accordingly, heated vacuum chambers have been used to improve the attainment of low pressures within the various vacuum compartments and to reduce the time required for evacuation. Such heating requires provision of heat sources that are thermally coupled to the vacuum chamber. Yet, as noted above, much heat generated by the various required vacuum pumps is wasted by conventional air cooling configurations, thereby causing the expenditure of additional electrical energy and generating excess laboratory noise and vibrations. Accordingly, alternative systems and methods for cooling a vacuum pump are desired.

SUMMARY

The inventors have realized that a fluid cooling loop can be routed inside the housing of an apparatus that has a vacuum chamber in order to continuously cool the vacuum pump(s) that generate(s) the vacuum. The fluid line may send coolant liquid through channels that are thermally coupled to the vacuum pump motor(s) in order to extract heat. The heated coolant liquid that exits the channels at the pump motor(s) is then routed to an external heat exchanger at which the heat is extracted. A liquid pump completes the fluid circuit. Alternatively, prior to entering the heat exchanger, the heated coolant liquid can be routed through one or more channels in a wall (or walls) of the vacuum chamber walls or through a tube that is in thermal contact with the wall(s) in order to raise the temperature of the chamber without requiring additional energy to generate the heat. The higher temperature of the chamber walls increases molecular energy in the internal chamber volume that is evacuated by the pump, thereby reducing the time required to reach the desired chamber pressure(s). In addition, the transfer of heat energy to the chamber wall surfaces naturally displace molecules that are adhered to the walls, thus further reducing the time required to reach an appropriate operating pressure. These heated chamber wall channels could also benefit instruments that have a large thermal gradient along the length of the vacuum chamber (i.e., hot on one end, cold on the other). Creatively placing the entrance and exit points for the flowing coolant along the chamber walls could provide a method to normalize the chamber wall temperature throughout the assembly.

According to a first embodiment of an apparatus for cooling a vacuum pump that is disposed within the housing of a scientific instrument or other industrial apparatus in accordance with the present teachings, a liquid cooling system is integrated into the instrument. This involves routing a fluid tubing line inside the instrument housing to fittings on the pump motor. The coolant liquid in this line is routed through channels or other conduits that are either in the pump motor assembly or in thermal contact with the pump motor assembly, such as being affixed to a housing portion of the pump motor assembly. The coolant may be then routed back out of the instrument housing to a heat exchanger that may be external to the apparatus. This closed-loop system cycles cool coolant liquid to the pump motor and brings warm coolant liquid out of the instrument where it can be cooled externally. According to a second embodiment of an apparatus in accordance with the present teachings, the path of the coolant liquid can be designed such that, after absorbing heat from the vacuum pump, the heated coolant liquid is routed through channels in the vacuum chamber's walls before it exits the system. The metal chamber walls absorb this heat and produce an environment that is more conducive to evacuation due to higher molecular energy within the chamber.

Using a liquid cooled system to cool the pump motor instead of fans provides opportunities to use the heat in other areas of the housing where it is beneficial to overall instrument operation. The beneficial feature of improving the ability to cool the pump is achieved through liquid cooling of the pump's motor or housing (or pumps' motors or housings) is augmented by the secondary benefit of a more efficient vacuum pumping environment inside the vacuum chamber as a result of the additional heat introduced into the chamber's walls. Using the exhaust heat from the pump allows for this secondary benefit without requiring additional energy or components to heat the vacuum chamber. This approach can be extended by configuring the fluid circuit that transports the coolant liquid to also come into thermal contact with either additional vacuum pumps or other heat-generating components inside the housing, such as other motors or electronic components, in order to offload heat to the cooling fluid circuit. The net effect is improved cooling of the instrument with fewer noise-generating fans and increased heat generation for the vacuum chamber's walls.

According to a method in accordance with the present teachings, the overall temperature of the vacuum chamber can be controlled by opening and closing a diverter valve in the fluid cooling loop. The method can include monitoring the chamber's temperature and controlling the flow rate of heated coolant liquid coming into thermal contact with the chamber walls as the chamber temperature increases. This method may be employed to control the operating temperature of the chamber and avoid overheating in this area of the instrument. Once the desired chamber temperature is reached, the diverter valve can be used to send more of the heated coolant liquid to the external heat exchanger through an alternate path that does not come into direct thermal contact with the chamber walls. This technique could be used to produce instruments that generate less noise and vibration than do conventional instruments. For instruments with varying temperatures inside the vacuum chamber, this technique could produce a more temperature-uniform environment inside the vacuum chamber.

BRIEF DESCRIPTION OF THE DRAWINGS

The above noted and various other aspects of the present invention will become apparent from the following description which is given by way of example only and with reference to the accompanying drawings, not necessarily drawn to scale, in which.

DETAILED DESCRIPTION

Figure 1:
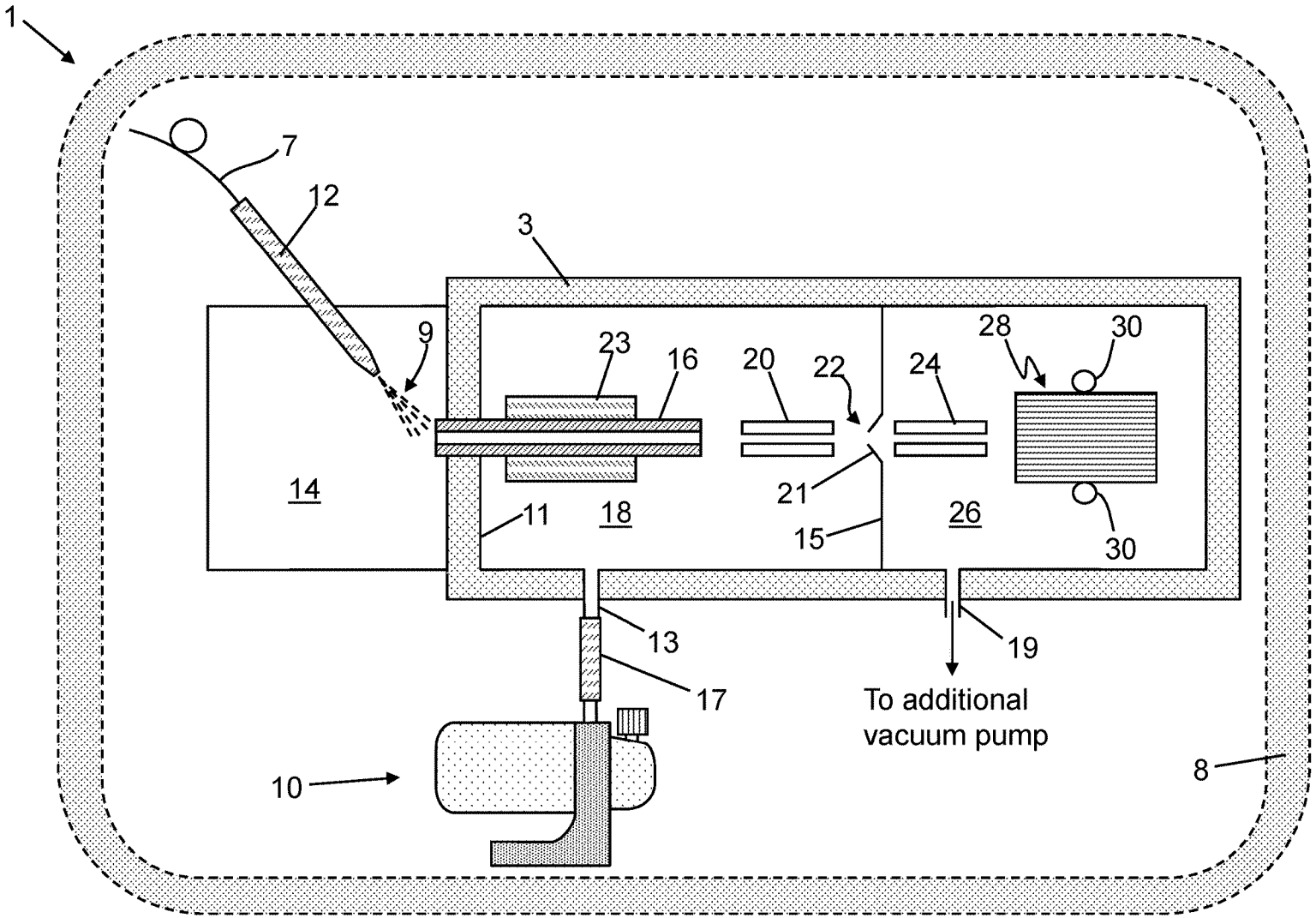
FIG. 1 (Prior Art)
FIG. 1 is a schematic diagram of a portion of a general conventional mass spectrometer system.

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. To fully appreciate the features of the present invention in greater detail, please refer to FIGS. 1-3 in conjunction with the following description.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that, for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise.

The term "coolant liquid", as used herein, refers to the liquid that is caused to flow within the fluid tubing lines, channels or other conduits that are portions of liquid circuits described herein. Depending upon the environment of any particular portion of such a liquid circuit, the coolant liquid within the portion may either absorb heat from the local environment, release heat to the local environment or possibly neither absorb nor release heat. For consistency, however, the liquid is referred to as a "coolant liquid" throughout. Unless otherwise defined, all other technical and scientific terms used herein have the meaning commonly understood by one of ordinary skill in the art to which this invention belongs. In case of conflict, the present specification, including definitions, will control. It will be appreciated that there is an implied "about" prior to the quantitative terms mentioned in the present description, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. As used herein, "a" or "an" also may refer to "at least one" or "one or more." Also, the use of "or" is inclusive, such that the phrase "A or B" is true when "A" is true, "B" is true, or both "A" and "B" are true.

Figure 2:
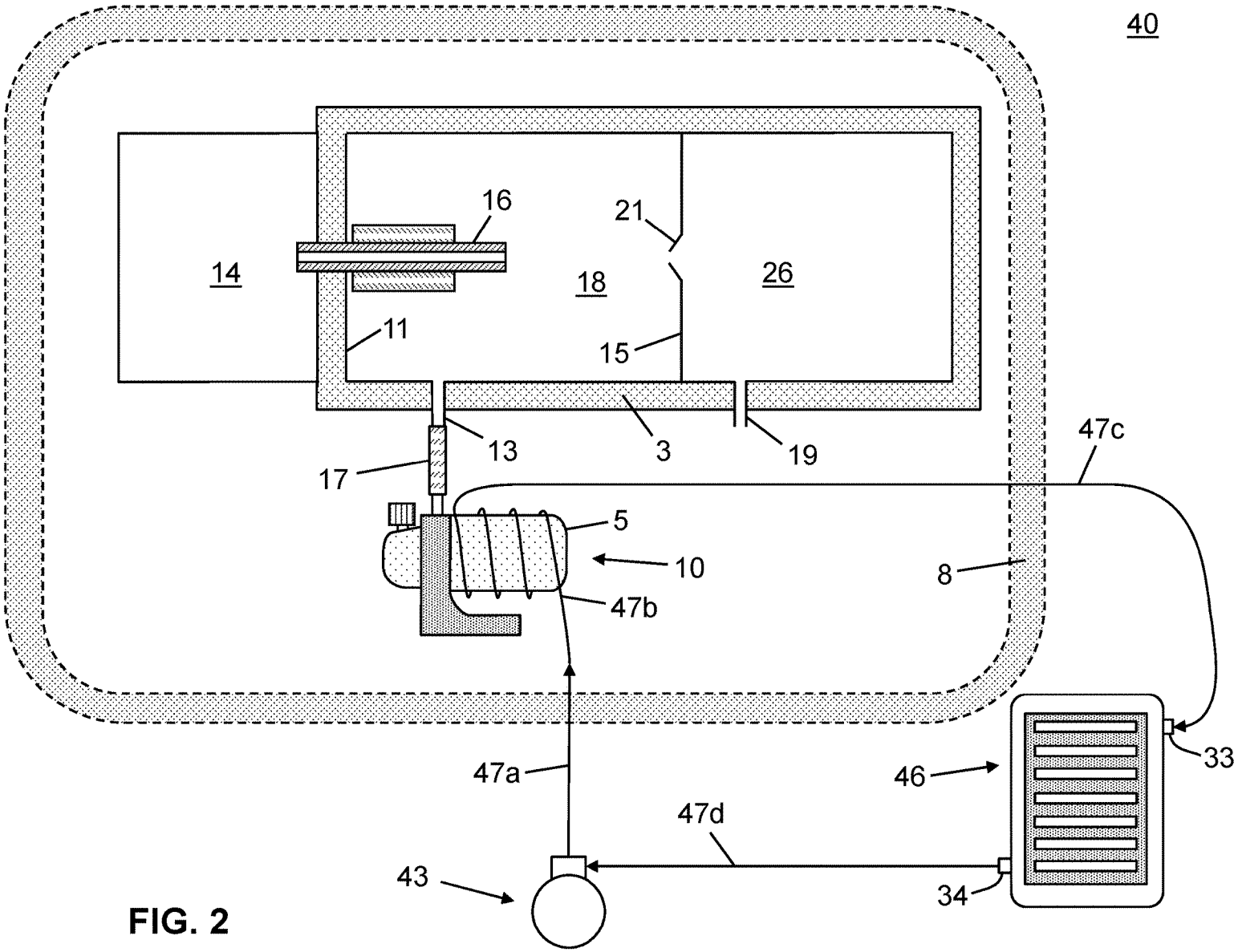
FIG. 2 is a schematic illustration of a system, in accordance with the present teachings, for cooling a vacuum pump of the mass spectrometer system of FIG. 1.

FIG. 2 is a schematic illustration of a system, in accordance with the present teachings, for cooling a vacuum pump of a scientific or industrial apparatus. Although illustrated with reference to the mass spectrometer system of FIG. 1, the vacuum pump cooling system of FIG. 1 and the principle of operation of this system is applicable to other scientific and industrial apparatuses that employ vacuum chambers that are evacuated by one or more vacuum pumps. To avoid a confusion of components and to emphasize the general applicability of the present teachings, only a limited number of mass-spectrometer-specific components are included in FIG. 2 (and FIG. 3). The illustrated mass spectrometer components are the ionization chamber 14, the ion transfer tube 16 and the skimmer 21.

The system 40 of FIG. 2 comprises a fluid circuit that includes a liquid pump 43, a heat exchanger 46 and various fluid tubing lines, channels or conduits 47*a*, 47*b* and 47*c*. The liquid pump 43 expels a coolant liquid, that may comprise, without limitation, water and/or ethylene glycol, into fluid tubing line 47*a* which, in the illustrated embodiment, transfers the coolant liquid into the chassis/housing 8 and into the vicinity of a motor housing 5 of the vacuum pump 10. The coolant liquid is transferred from the fluid tubing line 47*a* into a tubing, channel or other conduit 47*b* that is in thermal contact with the motor housing 5. The coolant liquid within the tubing, channel or conduit 47*b* extracts heat from the pump 10, thereby increasing the temperature of the coolant liquid. The so-warmed coolant liquid is then transferred to an inlet 33 of the heat exchanger 46 through fluid tubing line 47*c*. The heat exchanger 46, which may be of any suitable known type, is in thermal contact with either an ambient-temperature air bath, a chilled air bath or a liquid bath that extracts heat from the coolant liquid as that liquid passes through one or more fluid channels, tubes or other conduits within the heat exchanger. The so-chilled coolant liquid exits from an outlet 34 of the heat exchanger 46 and is transferred back to the pump 43 by fluid tubing line 47*d*, thus completing the fluid circuit.

Many types of heat exchangers are known in the art and may be used within the system 40. If the heat exchanger 46 is in thermal contact with an air bath (either at ambient temperature or chilled), then a fan may be employed so as to maintain a constant flow of air over about or through the heat exchanger. In contrast to conventional fan-based methods of cooling a vacuum pump, the provision of the fluid tubing lines, channels or conduits 47*a*, 47*b* and 47*c* enables the fan to be located remotely from the vacuum pump and its associated apparatus or even remotely from the laboratory environment. The remote placement of the fan may prevent noise and vibrations from interfering with apparatus or laboratory operations.

Preferably, the tubing, channel or conduit 47*b* comprises one or more fluid channels or other conduits within the body of the motor housing 5. Alternatively, the tubing, channel or conduit 47*b* may comprise a metal tube of high thermal conductivity, such as a copper or aluminum that is affixed to the outer surface of the motor housing 5, such as by solder. Such a tubing configuration is schematically illustrated in FIG. 2, showing several windings of the affixed tubing around the surface of the motor housing. As another alternative, the tubing, channel or conduit 47*b* may comprise a conduit or series of conduits within a specialized heat exchanger (for instance, a collar) that is designed to attach to and mate with the motor housing. The alternative configurations described above are appropriate in situations when the tubing, channel or conduit 47*b* is installed onto an existing vacuum pump when it is desired not to modify the vacuum pump proper.

Although FIG. 2 depicts only the single vacuum pump 10 as a heat-generating component within the apparatus housing 8, there will generally be additional heat-generating components disposed within the housing. For example, if the apparatus is a mass spectrometer as depicted in FIG. 1, then one or more additional vacuum pumps (such as a diffusion pump and/or a turbo-molecular pump, not shown) may be included within the housing in order to further evacuate compartment 26 through vacuum port 19 as well as to evacuate any additional compartments. Heat-generating electronics and additional motors (not shown) may also be disposed within the housing 8. Accordingly, in many instances, the fluid circuit that transports the coolant liquid may be extended so as to also sequentially come into thermal contact with the other heat-generating components inside the housing in order to off-load waste heat to the cooling fluid circuit.

Figure 3:
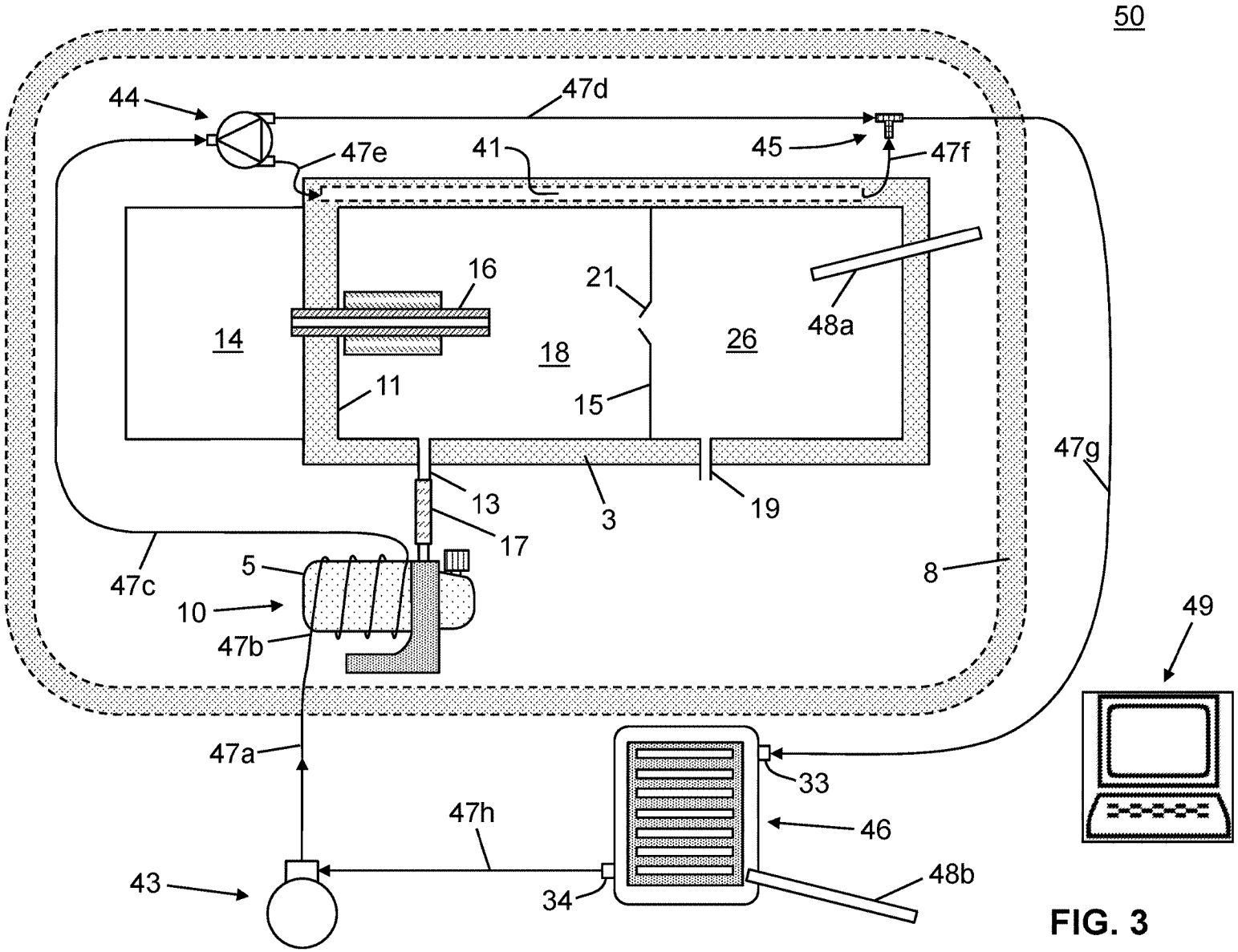
FIG. 3 is a schematic illustration of a first system, in accordance with the present teachings, for cooling a vacuum pump and heating a vacuum chamber of the mass spectrometer system of FIG. 1.

FIG. 3 is a schematic illustration of a system, in accordance with the present teachings, for cooling a vacuum pump while, at the same time, heating a vacuum chamber of a scientific or industrial apparatus that employs a vacuum chamber. With similarity to the depiction of FIG. 2, the mass spectrometer system of FIG. 1 is illustrated in FIG. 3 as a representative of a scientific instrument of this type, with most of the mass-spectrometer-specific components removed from the diagram. The system 50 depicted in FIG. 3 comprises the liquid pump 43, the heat exchanger 46 and the fluid tubing lines, channels or conduits 47*a*, 47*b* and 47*c* as already described in reference to FIG. 2. Further, as noted above with regard to FIG. 2, the fluid circuit may also come into thermal contact with the other heat-generating components (not shown) inside the chassis/housing 8. However, in contrast to the system 40 depicted in FIG. 2, the fluid tubing line 47*c* does not directly deliver the heated coolant liquid to the heat exchanger 46. Instead, in the system 50, the fluid tubing line 47*c* terminates at a diversion valve 44. The diversion valve 44 is configured to deliver the entire flow of the heated coolant liquid to either fluid tubing line, channel or other conduit 47*d* or to fluid tubing line, channel or other conduit 47*e* or, alternatively, to apportion the flow of the heated coolant liquid between the two fluid pathways 47*d*, 47*e*. Any coolant liquid that is delivered to the fluid tubing line, channel or conduit 47*d* by the valve 44 is caused to also pass through a tee-junction 45 and a fluid tubing line 47*g* so as to thereby return to the inlet 33 of heat exchanger 46. Any coolant liquid that is delivered to the fluid tubing line, channel or conduit 47*e* by the valve 44 is caused to pass into and through one or more channels, conduits or fluid tubing lines 41 either embedded within or otherwise in thermal contact with the body of the vacuum chamber 3. This coolant liquid then passes through tee-junction 45 and fluid tubing line 47*g* so as to thereby return to the inlet 33 of heat exchanger 46. Upon exiting the heat exchanger at outlet 34, the coolant liquid returns to the pump 43 through fluid tubing line 47*h*.

Having acquired heat energy from the vacuum pump 10, any so-heated coolant liquid that subsequently passes through fluid tubing line 47*c* and that is diverted into the one or more channels, conduits or fluid tubing lines 41 then releases all or a portion of this heat energy to the vacuum chamber 3. As a consequence, a portion of the heat energy is imparted to the compartments 18, 26 therein (assuming that the chamber and compartments are at a lower temperature than the heated coolant). The heating of gas within the compartments improves pumping efficiency and enables the attainment of lower pressures than would otherwise be achieved. Although flow through the one or more channels, conduits or fluid tubing lines 41 is depicted as being unidirectional through a single wall of the vacuum chamber 3 in FIG. 3, the conduits or fluid tubing lines may extend around or within multiple walls and may include one or more bends within or adjacent to each such wall in order to maximize the wall surface area that is in thermal contact with the coolant liquid. If there is an anticipated temperature gradient along the vacuum chamber, then the conduits or fluid tubing lines may be configured to direct the flow of coolant liquid first to cooler portions of the chamber and then to warmer sections so as to reduce or eliminate the gradient.

The temperature of the vacuum chamber interior or of one or more of its compartments may be measured by one or more temperature sensors 48*a* and regulated by a control system to maintain a set temperature (or temperature range) within the vacuum chamber 3. Non-limiting examples of suitable temperature sensors include thermocouple and thermistor sensors. The one or more temperature sensors 48*a* may be in electronic communication with a computer or other electronic controller 49 whereby a signal from the temperature sensor may be digitized, if the signal was previously in analog form. Similarly, the heat exchanger 46 may comprise one or more temperature sensors 48*b* that measure the temperature(s) of one or more of the air or liquid bath, the ambient environment, the coolant liquid at the inlet 33 and the coolant liquid at the outlet 34. The one or more temperature sensors 48*b* may be in electronic communication with the computer or other electronic controller 49 and analog signals, if any, from the one or more temperature sensors 48*b* may be digitized by the computer or other electronic controller. Further one or both of the diversion valve 44 and the liquid pump 43 may be in electronic communication with the computer or other electronic controller 49. Other temperature sensors (not shown) may be disposed so as to measure temperatures elsewhere in the system, such as at various locations within the fluid tubing lines, channels or conduits 47*a*, 47*b* and 47*c*.

The computer or other electronic controller 49 may comprise a separate general-purpose computer that is electronically coupled to the various physical components or may comprise electronic logic components and associated circuitry within the apparatus. The computer or other electronic controller 49 may comprise computer-readable instructions, either software-based or in firmware, that are operable to read and/or record temperature-related signals from the various temperature sensors and that are further operable, in response to the temperature signals, to control the operation of the liquid pump 43, the operation of the diversion valve 44 and/or the temperature of a liquid or air bath in contact with the heat exchanger 46. The operation of the liquid pump, diversion valve and/or heat exchanger bath fluid may be performed by control signals delivered to one or more of the liquid pump, diversion valve and heat exchanger over one or more electrical wires or cables (not shown) that couple these components to the computer or other electronic controller 49. One or more of the temperature(s) may be monitored and this information may be used to control either the temperature or the rate of flow of heated coolant liquid that passes through the conduits or fluid tubing lines 41 as the chamber temperature changes. The flow rate may be controlled by either the pumping speed or by the apportioning of flow between fluid tubing lines, channels or conduits 47*d* and 47*e*. This technique provides a method to control the operating temperature of the chamber and avoid overheating in this area of the instrument. Once the desired chamber temperature is reached, either the pumping speed of the pump 43 may be reduced or the diverter valve 44 may be configured to send more of the heated coolant liquid to fluid tubing line, channel or conduit 47*d* and then to the external heat exchanger 46.

According to a variation of the system 50 (not shown), both the temperature sensor 48*a* and the controller 49 may be replaced by a simple analog thermostat, such as a thermostat of the bi-metal type. The thermostat may act as an electrical switch that is directly coupled to an actuator of the diversion valve 44. In operation, the thermostatic switch may cause the diversion valve to send coolant liquid through the one or more channels, conduits or fluid tubing lines 41 when the internal chamber temperature exceeds a predetermined set point and to send the coolant liquid through the bypass fluid tubing line 47*d* otherwise. The additional one or more temperature sensors 48*b* may be absent from such a system.

Figure 4:
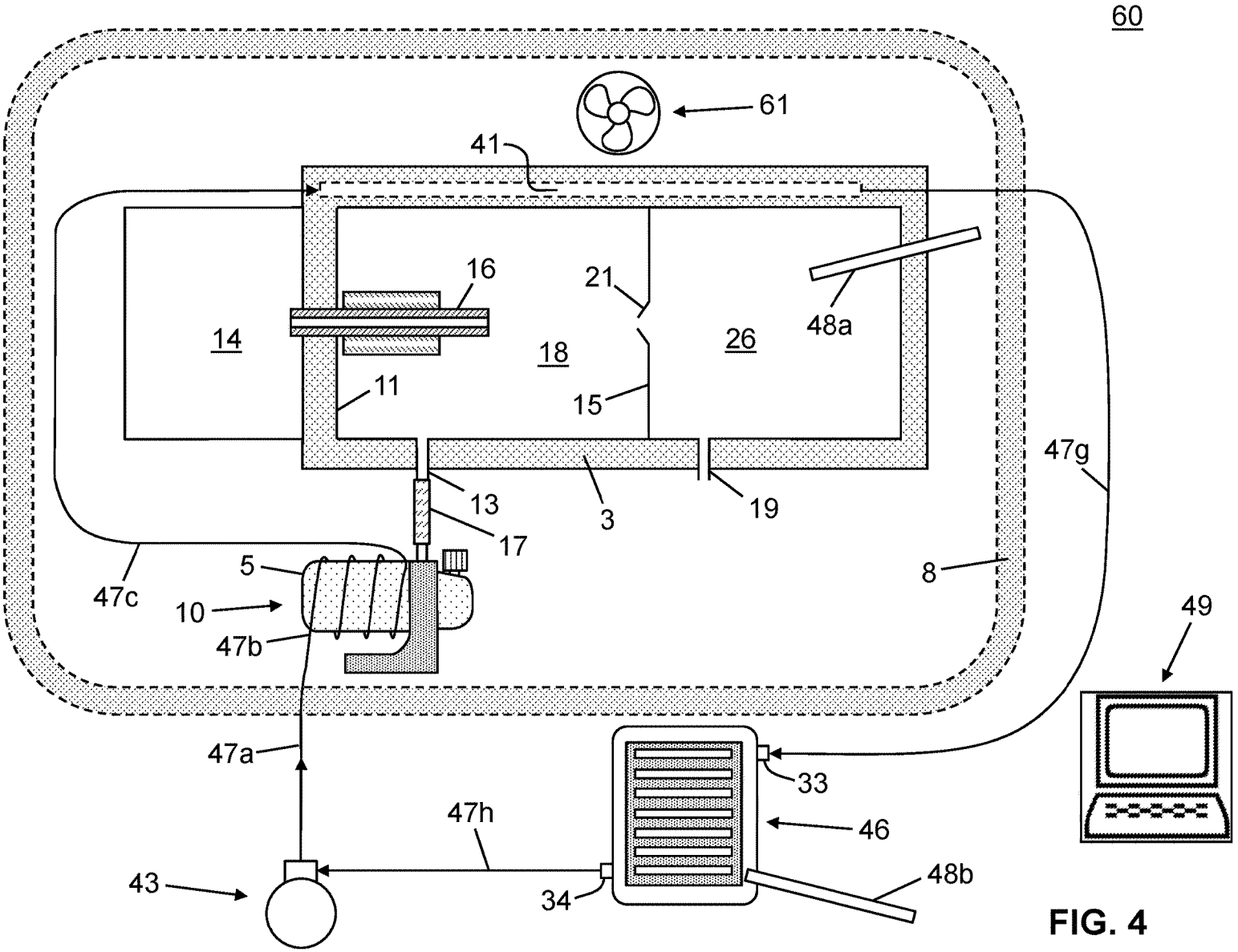
FIG. 4 is a schematic illustration of a second system, in accordance with the present teachings, for cooling a vacuum pump and heating a vacuum chamber of the mass spectrometer system of FIG. 1.

FIG. 4 is a schematic illustration of a second system, in accordance with the present teachings, for cooling a vacuum pump and heating a vacuum chamber of the mass spectrometer system of FIG. 1. The system 60 depicted in FIG. 4 differs from the system 50 of FIG. 3 in that the system 60 does not include any of the diversion valve 44, the tee-junction 45 and the fluid tubing lines 47*e*, 47*f*. Instead, within the system 60, the fluid tubing line 47*c* delivers coolant liquid directly to an inlet of the one or more channels, conduits or fluid tubing lines 41 and the fluid tubing line 47*g* directly receives the coolant liquid from an outlet of the one or more channels, conduits or fluid tubing lines 41. Accordingly, the heated coolant liquid continuously flows through the one or more channels, conduits or fluid tubing lines. During operation of the system 60, the temperature control system operates to control a variable speed fan 61, such as by transmitting a control signal to the fan over electrical wires or cables (not shown), that sends air flow onto or across a portion of the exterior of the vacuum chamber 3. The control system increases the air flow provided by the fan 61 if the chamber temperature rises and reduces the air flow if the chamber temperature decreases. The temperature control system may also operate to similarly control the pumping speed of the liquid pump 43. The variable speed fan 61 is smaller than fans that are used to cool the vacuum pump 10 in conventional systems, since a portion of the heat that is generated by the vacuum pump is absorbed by the vacuum chamber 3 and the heat exchanger 46. The variable speed fan therefore utilizes less electrical power and produces less noise and vibration than do fans of conventional systems.

Improved systems and methods have been herein disclosed for removing heat from a vacuum pump of an apparatus that includes a vacuum chamber. Various embodiments of the systems and methods in accordance with the present teachings make use of the heat energy that is received from the vacuum pump by transporting at least a portion of the heat to the vacuum chamber and thereby improving pumping efficiency. The discussion included in this application is intended to serve as a basic description. The present invention is not intended to be limited in scope by the specific embodiments described herein, which are intended as single illustrations of individual aspects of the invention. Functionally equivalent methods and components are within the scope of the invention. For example, although a heat exchanger 46 has been illustrated as being disposed outside of a housing 8 of an apparatus in question, some applications may require the heat exchanger to be disposed within the housing (e.g. for purposes of overall apparatus compactness or because an external heat exchanger is not available or feasible). Similarly, the liquid pump 43 may be disposed within the apparatus housing. As another example, although the present teachings are generally applicable to an apparatus that includes a vacuum pump within the apparatus housing, some applications may require the vacuum pump to be disposed on its own separate chassis and within its own separate housing (e.g., for purposes of vibration isolation or structural support of a heavy vacuum pump. In such instances, removal of heat from the vacuum pump may be necessary or required in order to avoid overheating and, in such instances, the principles and features taught herein will still apply. Various other modifications of the invention, in addition to those shown and described herein will become apparent to those skilled in the art from the foregoing description and accompanying drawings.

Any patents, patent applications, patent application publications or other literature mentioned herein are hereby incorporated by reference herein in their respective entirety as if fully set forth herein, except that, in the event of any conflict between the incorporated reference and the present specification, the language of the present specification will control.

We claim:

1. A method comprising:

heating a flow of a coolant liquid by passing the flow through one or more fluidic tubing lines, channels or conduits that are in thermal contact with a housing of a vacuum pump;

apportioning the flow of the heated coolant liquid between a first partial flow in a bypass fluid tubing line and a second partial flow in a channel within a wall of a vacuum chamber;

recombining the first and second partial flows of the heated coolant liquid;

passing the recombined flow of the coolant liquid through a heat exchanger that cools the coolant liquid; and recirculating the cooled coolant liquid through the one or more fluidic tubing lines, channels or conduits that are in thermal contact with the vacuum pump housing, wherein the apportionment of the flow of the heated coolant liquid is automatically performed under the control of an electronic controller or computer in response to a temperature measurement received by the electronic controller or computer.

2. A method as recited in claim 1, wherein the vacuum chamber is disposed within a housing of a mass spectrometer, an electron microscope or a chemical vapor deposition apparatus.

3. A method as recited in claim 2, wherein the step of passing the recombined flow of the coolant liquid through the heat exchanger comprises passing the recombined flow of the coolant liquid through a heat exchanger that is disposed outside of the housing of the mass spectrometer, electron microscope or chemical vapor apparatus.

4. A method as recited in claim 2, wherein the step of heating the flow of the coolant liquid comprises passing the flow through the one or more fluidic tubing lines, channels or conduits that are in thermal contact with the housing of the vacuum pump, wherein the vacuum pump is disposed within the housing of the mass spectrometer, electron microscope or chemical vapor apparatus.

5. A system comprising:

a vacuum chamber disposed within a housing and having:

a vacuum port; and a wall having a channel therein, said channel comprising a channel inlet and a channel outlet;

a vacuum pump having a gas inlet port that is fluidically coupled to the vacuum port;

one or more fluidic tubing lines, channels or conduits in thermal contact with a housing of the vacuum pump, wherein an outlet of the one or more fluidic tubing lines, channels or conduits is fluidically coupled to the channel inlet of the channel of the wall of the vacuum chamber;

a liquid pump fluidically coupled to an inlet of the one or more fluidic tubing lines, channels or conduits that are in thermal contact with the vacuum pump housing;

a heat exchanger comprising:

a heat exchanger inlet that is fluidically coupled to the channel outlet of the channel of the vacuum chamber wall; and a heat exchanger outlet that is fluidically coupled to the liquid pump;

a diverter valve fluidically coupled between the channel inlet of the channel of the vacuum chamber wall and the outlet of the one or more fluidic tubing lines, channels or conduits that are in thermal contact with the vacuum pump housing;

a tee-junction fluidically coupled between the heat exchanger inlet and the channel inlet of the channel of the vacuum chamber wall; and a bypass fluid tubing line or conduit fluidically coupled between the diverter valve and the tee-junction.

6. A system as recited in claim 5, further comprising:

a temperature sensor within the vacuum chamber; and an electronic controller or computer configured to receive a temperature-dependent signal from the temperature sensor and configured to transmit a control signal to the diverter valve, wherein the electronic controller or computer comprises computer-readable instructions that are operable to cause transmission of the control signal in response to the temperature-dependent signal.

7. A system as recited in claim 6, wherein the control signal causes the diverter valve to deliver either all of, a portion of or none of a flow of a coolant liquid to the channel inlet of the channel of the vacuum chamber wall.

8. A system as recited in claim 5, wherein the vacuum chamber is a component of the group consisting of a mass spectrometer, an electron microscope and a chemical vapor deposition apparatus.

* * * * *